US008585230B2

(12) United States Patent
Schopper

(10) Patent No.: US 8,585,230 B2
(45) Date of Patent: Nov. 19, 2013

(54) LOW-PROFILE E-READER LIGHT

(76) Inventor: Phillip Schopper, New York, NY (US)

( * ) Notice: Subject to any disclaimer, the term of this patent is extended or adjusted under 35 U.S.C. 154(b) by 263 days.

(21) Appl. No.: 13/164,433

(22) Filed: Jun. 20, 2011

(65) Prior Publication Data

US 2012/0320604 A1 Dec. 20, 2012

(51) Int. Cl.
*F21V 33/00* (2006.01)
*F21V 7/00* (2006.01)

(52) U.S. Cl.
USPC ..... 362/98; 362/99; 362/307; 362/603

(58) Field of Classification Search
USPC ..... 362/98, 99, 307, 603
See application file for complete search history.

(56) References Cited

U.S. PATENT DOCUMENTS 4,893,221 A * 1/1990 Friedman ..... 362/108
6,213,618 B1 * 4/2001 Dobbin et al. ..... 362/99
6,361,184 B1 * 3/2002 Hallgrimsson et al. ..... 362/188
6,736,531 B2 * 5/2004 Wallach ..... 362/414
2003/0081407 A1 * 5/2003 Bennett, Jr. ..... 362/98
2006/0268539 A1 * 11/2006 Rodriguez et al. ..... 362/98

* cited by examiner

*Primary Examiner* — Stephen F Husar
*Assistant Examiner* — James Cranson, Jr.
(74) *Attorney, Agent, or Firm* — Epstein Drangel LLP; Robert L. Epstein

(57) ABSTRACT

A device for illuminating a surface of a member is provided that includes a light transmissive element having a substantially planar surface adapted to be situated over and separated from the member surface. The device also includes a light source adapted to emit light rays that directly illuminate the member surface and light rays directed between the element surface and the member surface at an angle causing a substantial portion of the light rays to be reflected by the element surface onto the member surface to illuminate the member surface. The light rays reflected from the member surface pass through the element such that the illuminated member surface can be observed. An apparatus for illuminating a surface is provided that includes an arrangement reflecting light toward the member that is positioned over the member and separated from the member by a gap, and an arrangement emitting light into the gap.

15 Claims, 19 Drawing Sheets

LOW-PROFILE E-READER LIGHT

CROSS-REFERENCE TO RELATED APPLICATIONS

This application claims the benefit of U.S. Provisional Application No. 61/298,109 filed Jun. 21, 2010, which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention relates to book lights, and in particular relates to a compact light system compatible with books and e-readers.

2. Description of the Related Art

Light for reading books has been provided by sunlight, general room illumination, desktop lamps, and book lights that attach to the book. E-readers (also referred to herein as e-books) use e-ink to write erasable text on a screen, and may be read in ambient light. E-readers typically do not include a light source for illumination, which may make them difficult to use in dimly lit areas.

U.S. Pat. No. 6,951,403 discusses a device for illuminating a generally flat surface essentially without emitting significant light beyond the surface is particularly adapted for use as a book light. The device comprises a battery-operated light source contained within a housing to which a transparent light-conductive illuminating body is mounted in close adjacency to the light source to transmit the light through the illuminating body. The device may be placed with the illuminating body over a book or other flat surface for illuminated viewing through the transparent illuminating body. The illuminating body is tapered in a wedge shape to deflect the conducted light onto the underlying surface. In U.S. Pat. No. 6,951,403, the device apparently conducts light through the conductive, illuminating body.

There is a need for a low-profile e-reader light that is effective.

BRIEF SUMMARY OF THE INVENTION

The present application discusses illumination of e-readers, e-books (for instance a Kindle or Nook), traditional books and other objects having generally flat surfaces, using a device having low profile. The device provides sufficient light to read comfortably, while reducing the amount of light that spills over beyond the particular screen it is intended to illuminate. The device may lie flat when not in use and thus may be carried along with the product it is intended for without being cumbersome or adding significant weight.

A device for illuminating a surface of a member is provided that includes a light transmissive element having a substantially planar surface adapted to be situated over and separated from the member surface. The device also includes a light source adapted to emit light rays directed between the element surface and the member surface at an angle causing a substantial portion of the light rays to be reflected by the element surface onto the member surface to illuminate the member surface, and from the member surface through the element such that the illuminated member surface can be observed.

The member may be book or an e-reader, and the element may be glass, plexiglas and/or plastic.

The device may include spacer elements for maintaining the separation between the element surface and the member surface. The spacer elements may allow a portion of the light rays to be projected on an area beyond a bottom edge of the element.

The device may include an arrangement for mounting the light source to direct the light rays between the element and the member.

The device may include an arrangement for mounting the element at the member with the light source therebetween, the element being inclined relative to the member.

The device may include a mount for the light source able to mounted in a use position and a stored position. The mount in the use position may contact a top edge of the surface of the member and the mount in the stored position may be above the member.

The device may include a power supply electrically coupled to the light source. The power supply may be positioned in the mount or in an e-reader holder.

The device may include an arrangement for removably attaching the element to the mount and an arrangement for aligning the element when the element is attached to the mount.

The device may include a lens coupled to the mount in proximity to the light source. The lens may spread the light rays emitted from the light source. The light source may be one or more LEDs.

The element may cause substantially all light rays intersecting the element at a high angle of incidence to be reflected. The light source may be adapted to emit a first set of the light rays directed substantially parallel to the element to intersect the member at a first set of points without being reflected between the light source and the first set of points. The light source may be adapted to emit a second set of the light rays directed substantially parallel to the element to intersect the element at a second set of points without being reflected between the light source and the second set of points.

The second set of the light rays may intersect the element at angles greater than the high angle of incidence and are reflected. The element may be adapted to direct the reflected light rays toward the member. The member may be adapted to reflect substantially all of the light rays that are reflected by the element toward the member. The element may be adapted to transmit substantially all of the light rays reflected by the member toward the element at angles less than the high angle of incidence. In this manner, the e-reader will receive both direct and reflected light.

An apparatus for illuminating a surface of a member is provided that includes an arrangement for reflecting light toward the member. The arrangement for reflecting light is positioned over the member and separated from the member by a gap. The apparatus also includes an arrangement for emitting light substantially parallel to the arrangement for reflecting light and into the gap.

The member may be a book or an e-reader, and the arrangement for reflecting light may include glass, plexiglas and/or plastic.

The apparatus may include an arrangement for spacing the arrangement for reflecting light from the member.

The apparatus may include an arrangement for mounting the arrangement for emitting light to direct light rays between the arrangement for reflecting light and the member. The apparatus may include an arrangement for mounting the arrangement for reflecting light at the member with the arrangement for emitting light therebetween. The arrangement for reflecting light may be inclined relative to the member.

The arrangement for reflecting light may cause substantially all light rays intersecting the transparent element at a high angle of incidence to be reflected.

The arrangement for emitting light may be adapted to emit a first set of the light rays directed substantially parallel to the transparent element to intersect the member at a first set of points without being reflected between and the first set of points. The arrangement for emitting light may be adapted to emit a second set of the light rays directed substantially parallel to the transparent element to intersect the transparent element at a second set of points without being reflected between the light source and the second set of points.

The second set of the light rays may intersect the element at angles greater than the high angle of incidence and are reflected. The transparent element may be adapted to direct the reflected light rays toward the member. The member may be adapted to reflect substantially all of the light rays that are reflected by the transparent element toward the member. The transparent element may be adapted to transmit substantially all of the light rays reflected by the member toward the transparent element at angles less than the high angle of incidence.

These objects and the details of the invention will be apparent from the following description and accompanying drawings.

DETAILED DESCRIPTION OF THE INVENTION

The present invention assists in illuminating an e-reader or book, and may be referred to herein as a low-profile e-reader light, a glowing e-reader light, a glow light, a glow, or an e-reader light. Illumination may come from a series of low voltage light emitting diodes (also referred to herein as LEDs) arrayed in a small housing that rests directly on the primary, or front, surface of the object it is illuminating. Each of the LEDs has a moderately broad spreading pattern that overlaps with the one nearby and forms an even field of light that is aimed essentially straight ahead, parallel to the surface of the e-book (also referred to herein as an e-reader) or other object it is intended to illuminate. Alternatively, the light may be provided by any appropriate device. The LEDs or other light sources may be referred to hereinafter as a light source.

Attached to this light housing is a sheet of transparent material, such as clear acrylic plastic, that may cover an area slightly larger than the screen it is illuminating (also referred to herein as a light transmissive element). The transparent sheet is fixed at a narrow, or low, angle that runs from above the LEDs down to the surface of the e-book (or other object), resting on it somewhat below the e-book's screen. Because the light from the LEDs strikes the under-surface of the transparent sheet at a shallow angle (also referred to herein as a high angle of incidence) much of it is reflected downward and illuminates the intended area.

The light from the LEDs strikes both the e-book's screen and the under-surface of the transparent sheet. The light angles to the screen and transparent sheet are nearly perpendicular near the LEDs and become increasingly oblique or shallow as the distance from the LEDs increases. The nature of the reflection process of the light from the transparent sheet (as it is with glass) is such that the amount of energy that is reflected from, rather than transmitted through, the sheet increases as the light angle becomes more oblique (shallower). Thus, the reflectivity of the transparent sheet increases with increasing distance from the LEDs, and because of the light reflecting from the underneath side, the presence of the transparent sheet considerably enhances the illumination of the e-book's screen (or book's surface) with increasing distance from the LEDs. The light transmissive element may be a thin, flat piece, and therefore lightweight.

Figure 1:
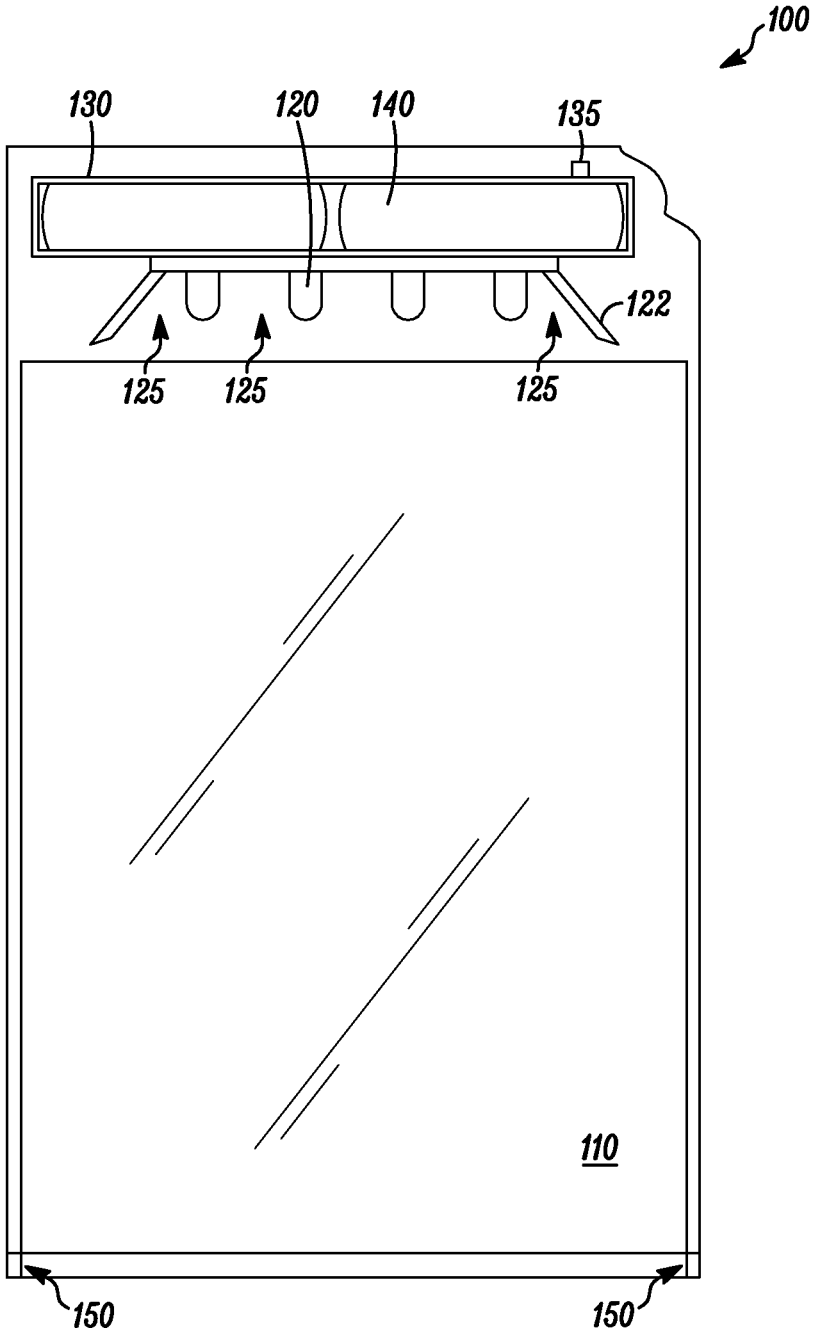
FIG. 1 is an underside view of an exemplary embodiment according to the present application.

FIG. 1 is an underside view of an exemplary embodiment of a glowing e-reader light according to the present application. Glow 100 includes light transmissive element 110, which is substantially transparent and may be Plexiglas. Glow 100 also includes four LEDs 120, though more or fewer LEDs may be used, or alternatively another light source may be used. Side reflecting surfaces 122 may be arranged on one or both ends of the set of LEDs 120, and may be angled to promote the reflection of light onto the surface of an e-reader or book, and/or onto the bottom surface of element 110 at a high angle of incidence. Surfaces 122 and/or the element on which LEDs 120 are mounted, may be coated with reflective material 125. LEDs 120 may be mounted on mount 130, which may include switch 135 on an exterior area, and battery compartment 140 in an interior. Spacer elements 150 may be arranged on an end of element 110 opposite mount 130.

Since LEDs require very little power, the source for that power may be small batteries. Those batteries may reside in the same housing as the LEDs themselves, attached to the transparent sheet. Alternatively, it may be desirable to place the batteries in a different configuration, for example along the side of the e-book or built into its protective or decorative jacket.

The illumination device has a low profile and provides effective illumination due to the high angle of incidence, or grazing angle, of the light against the transparent screen or cover. The light from the device's LEDs (for example, LEDs with a 30 degree light spread) is aimed substantially parallel to the surface of the e-reader, while the transparent material through which the viewer reads is inclined at approximately three degrees from parallel, and may in particular be at 2.6 or 2.7 degrees. Alternatively, the transparent material may be arranged at any appropriate angle with respect to the e-book, for instance anywhere from zero degrees to 30 degrees, and more preferably, two degrees to eight degrees. Therefore, the light striking the under surface of the transparent material is at a very shallow angle (also referred to herein as a high angle of incidence). Therefore, most of the light will either hit the e-reader's surface directly or be reflected onto it after initially hitting the undersurface of the transparent material. Therefore a high percentage of the light rays emitted from the LEDs reflects off the reading surface.

Further, illumination is evened out quite well across the surface of the device for, while the amount of direct light is being spread thinner the farther from the light source, the reflected light is increased due to striking the transparent material at an ever shallower angle. (Also, due to the shallow angle of the transparent material, very little unwanted light travels in the direction of the viewer's eyes without first reflecting off the e-reader surface. A coating of opaque paint or other material may be used on the top or bottom surface of the transparent material in the vicinity of the LEDs, namely near the top and above a top edge of the viewing screen of an e-reader, in order to block some or all of the direct light from the LEDs that may be closer to perpendicular due to the proximity to the LED source. The result is an evenly lit e-reader with little excess light elsewhere.

Various designs may be utilized for diffusing or spreading the direct light from the lower half of the LEDs, while maintain the upper halves of the LEDs without interruption so as to minimize hot spots on the surface of the light transmissive element, while getting maximum use of the LEDs further down the screen.

The amount of reflected light may depend on both the angle and the density of the material the light is hitting. The density of common commercial grade ⅛th inch clear acrylic plastic, and its consequent refractive index, may be sufficient for this purpose when positioned at an approximately three degree angle to the light source, and may thereby provide good illumination of the surface below.

Another exemplary embodiment of the present invention is for use with an e-reader carrying case. In this version, is different from the two in-case versions discussed above, in that while both in-the-case versions incorporate a power supply built into the case, this version has the LED light unit attached to the clear screen portion of the device. The clear screen attaches at a critical angle so that, when mounted on the power supply, the LEDs are aimed substantially parallel to the surface of the e-reader.

Figure 2:
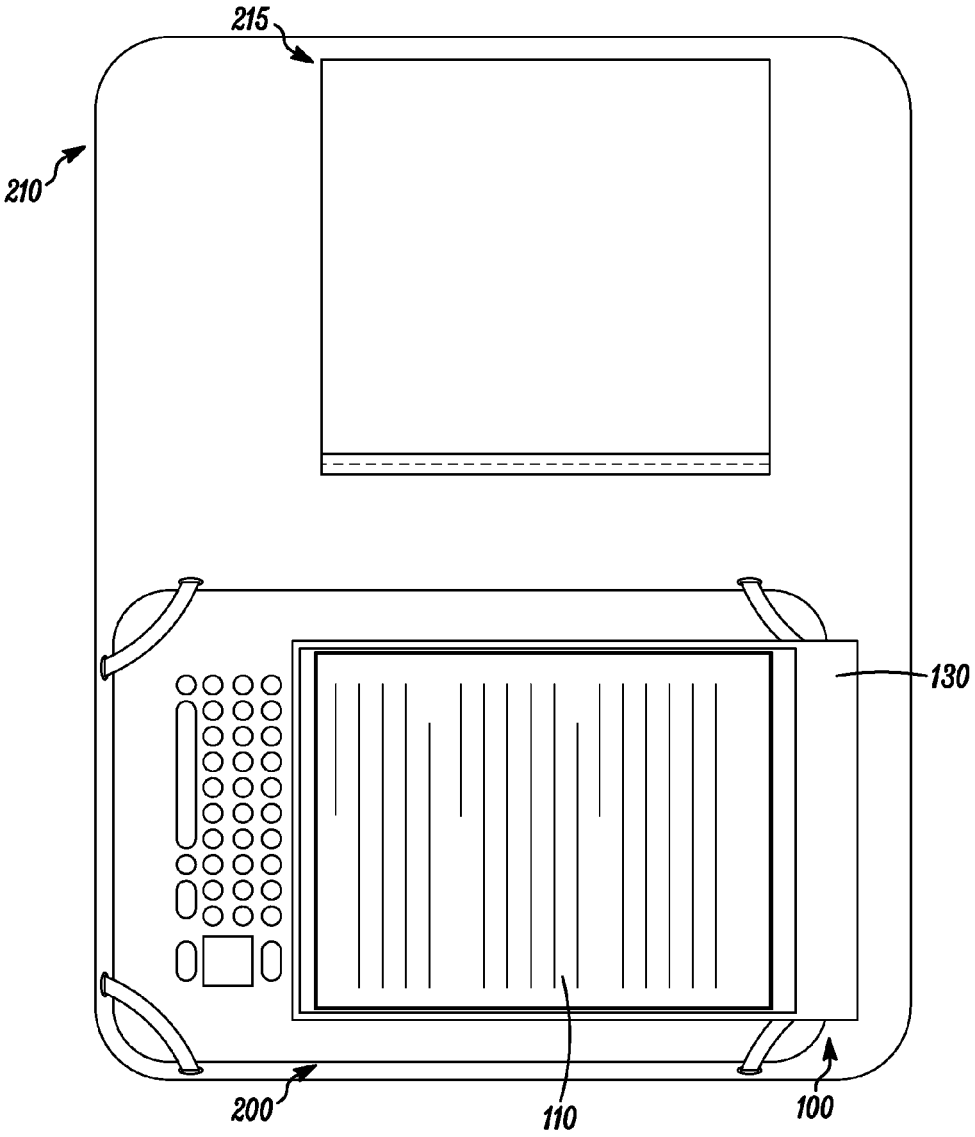
FIG. 2 is a plan view of an exemplary embodiment according to the present application in an e-book case and in a use position.

FIG. 2 is a plan view of an exemplary glowing e-reader light according to the present application in e-book case 210 and in a use position. Glow 100 includes light transmissive element 110 positioned over e-reader 200, with mount 130 positioned on a top edge of e-reader 200. Pocket 215 on e-book case 210 is adapted to receive light transmissive element 110 when not in use.

Figure 3:
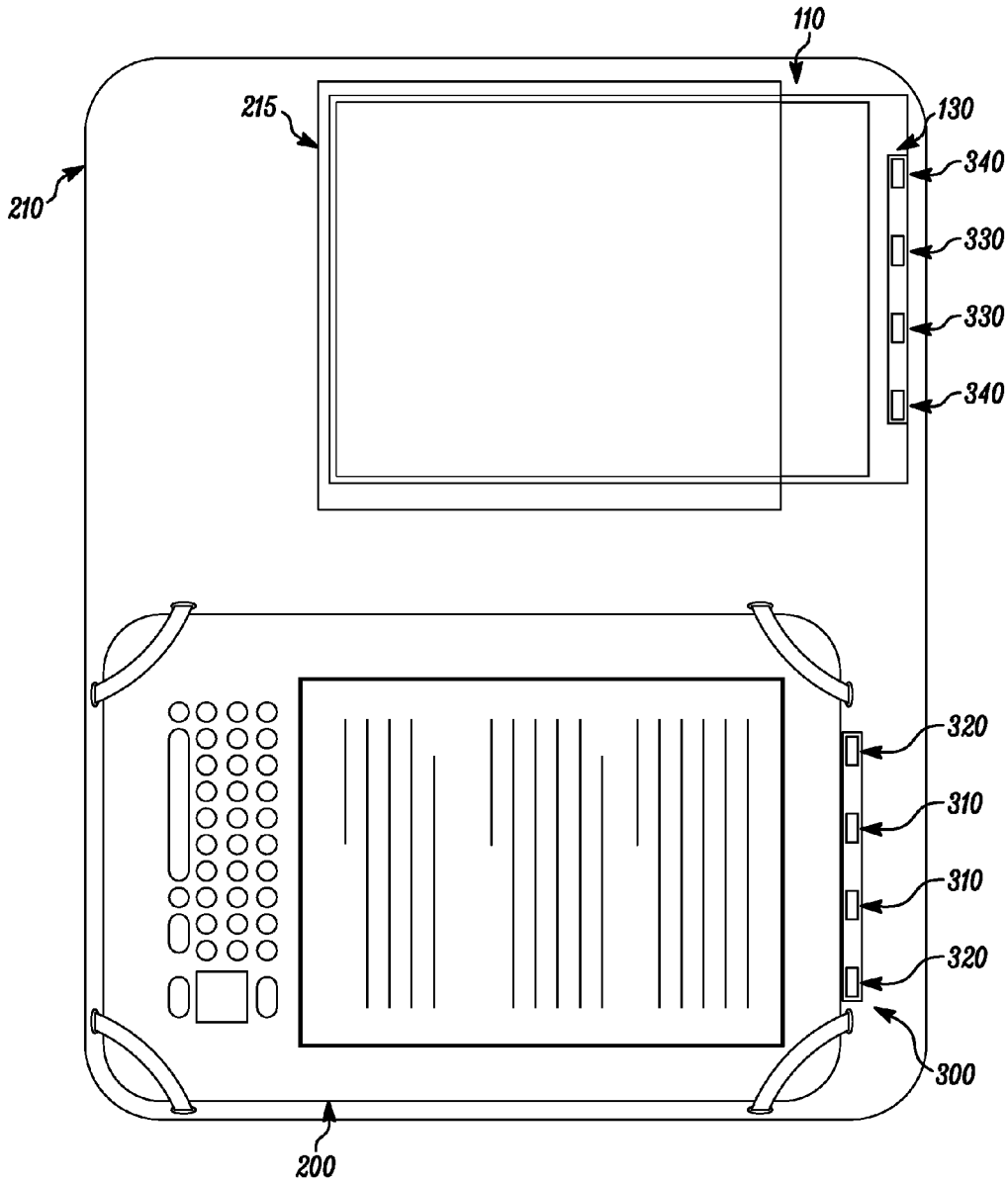
FIG. 3 is a plan view of an exemplary embodiment according to the present application in an e-book case and in a stored position.

FIG. 3 is a plan view of an exemplary glowing e-reader light according to the present application in e-book case 210 and in a stored position. Light transmissive element 110 with mount 130 is positioned within pocket 215 on e-book case 210. Power supply 300 is positioned on a top edge of e-reader 200 and includes power supply contacts 310 and power supply magnets 320. Power supply contacts 310 are adapted to contact mount contacts 330 when power supply magnets 320 contact mount magnets 340 for positioning and holding light transmissive element 110 over e-reader 200.

Magnetic coupling and exposed power contacts may be used to improve convenience and appearance. The contacts on the power supply may each be mounted from beneath on a simple piece of spring steel so that they rise above the surface slightly and go down when the screen/light unit is mounted to the magnets, thus insuring a good contact.

Figure 4:
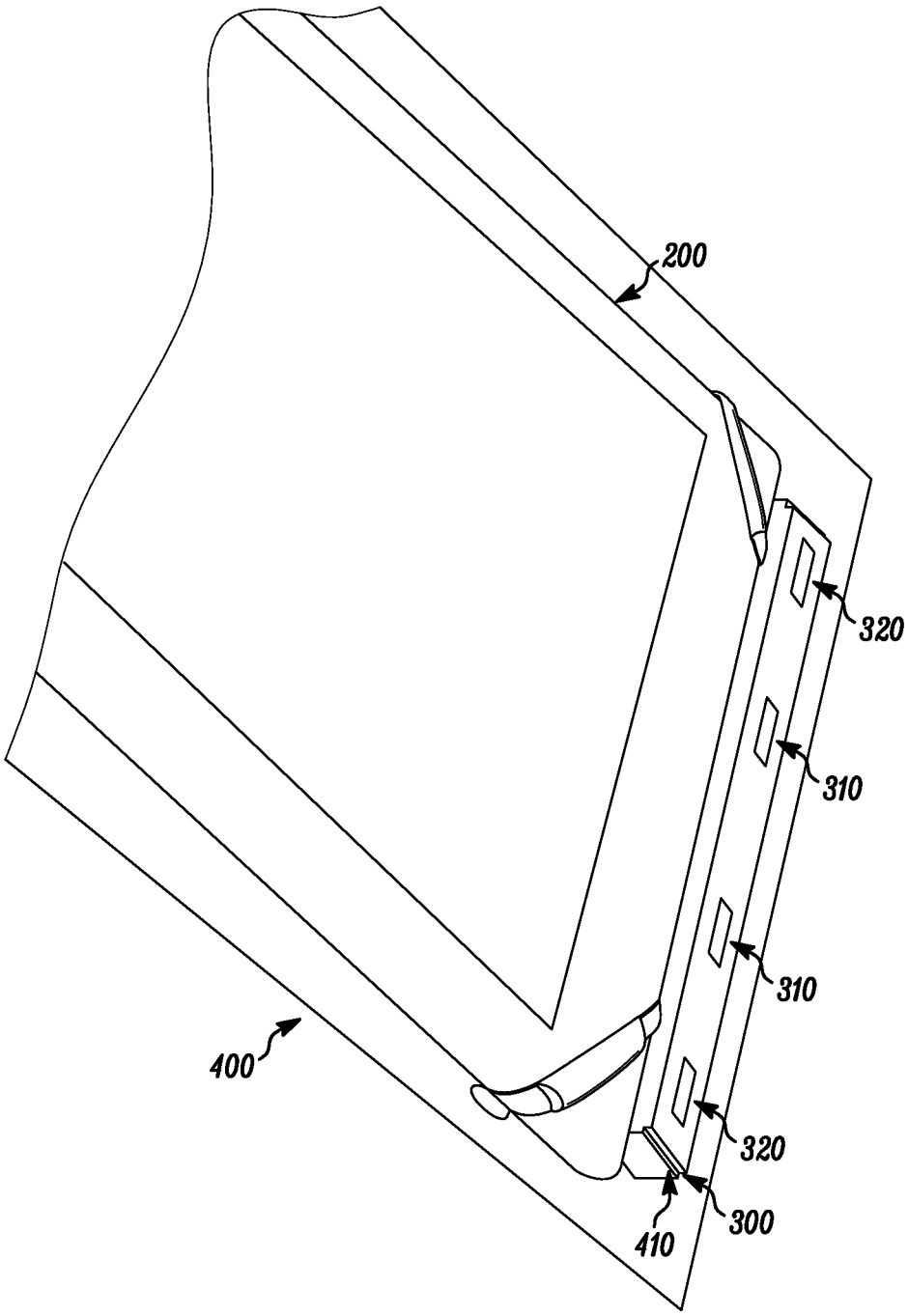
FIG. 4 is a perspective view of an exemplary embodiment according to the present application in a basic e-book case in a partially disassembled state.

FIG. 4 is a perspective view of an exemplary glowing e-reader light according to the present application in basic e-book case 400 in a partially disassembled state. Power supply 300 is positioned on a top edge of e-reader 200 and includes power supply contacts 310 and power supply magnets 320. Power supply 300 includes aligning indent 410 on an edge for promoting the easy positioning and alignment of a light transmissive element over e-reader 200.

Figure 5:
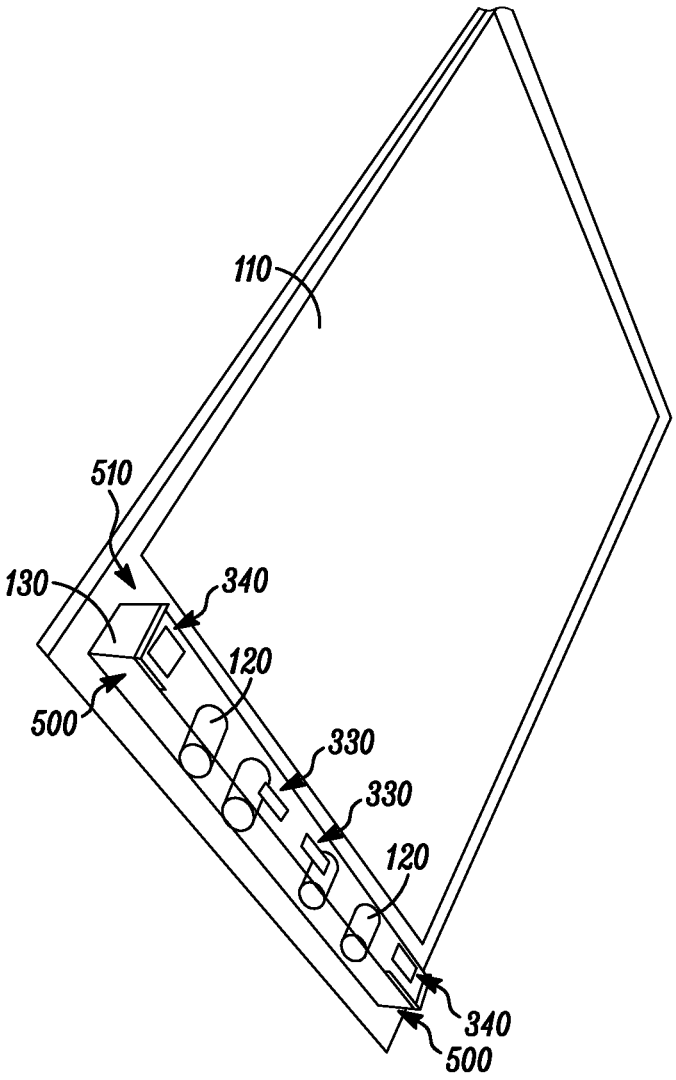
FIG. 5 is a perspective view of an exemplary embodiment according to the present application for use with a basic e-book case in a partially disassembled state.

FIG. 5 is a perspective view of an exemplary glowing e-reader light according to the present application for use in a basic e-book case in a partially disassembled state. Light transmissive element 110 with mount 130 including mount contacts 330 and mount magnets 340. Mount 130 also includes ridges 500 positioned to cooperate with aligning indents on a power supply to promote the easy positioning and alignment of light transmissive element 110 over an e-reader. Mount 130 may include cant 510 which is adapted to promote a substantially parallel alignment to LEDs 120 with respect to an e-reader, and may in particular be 2.5 to 8 degrees from parallel representing approximately the angle of light transmissive element 110 to an e-reader when transmissive element 110 is mounted the e-reader.

Figure 6:
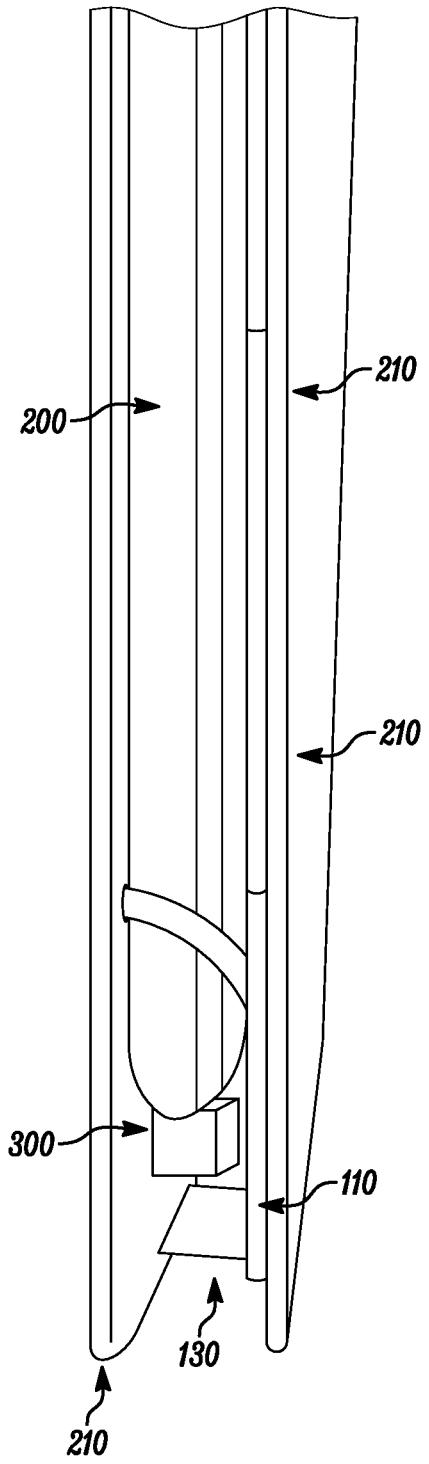
FIG. 6 is a partial side view of an exemplary embodiment according to the present application in an e-book case in a stored position.

FIG. 6 is a partial side view of an exemplary glowing e-reader light according to the present application in e-book case 210 in a stored position. Light transmissive element 110 with mount 130 is positioned within a pocket of e-book case 210. Power supply 300 is positioned on a top edge of e-reader 200. Closed e-book case including stored glowing e-reader light is not significantly thicker than an e-book case and e-reader alone, and therefore glowing e-reader light is not bulky or inconvenient.

Figure 7:
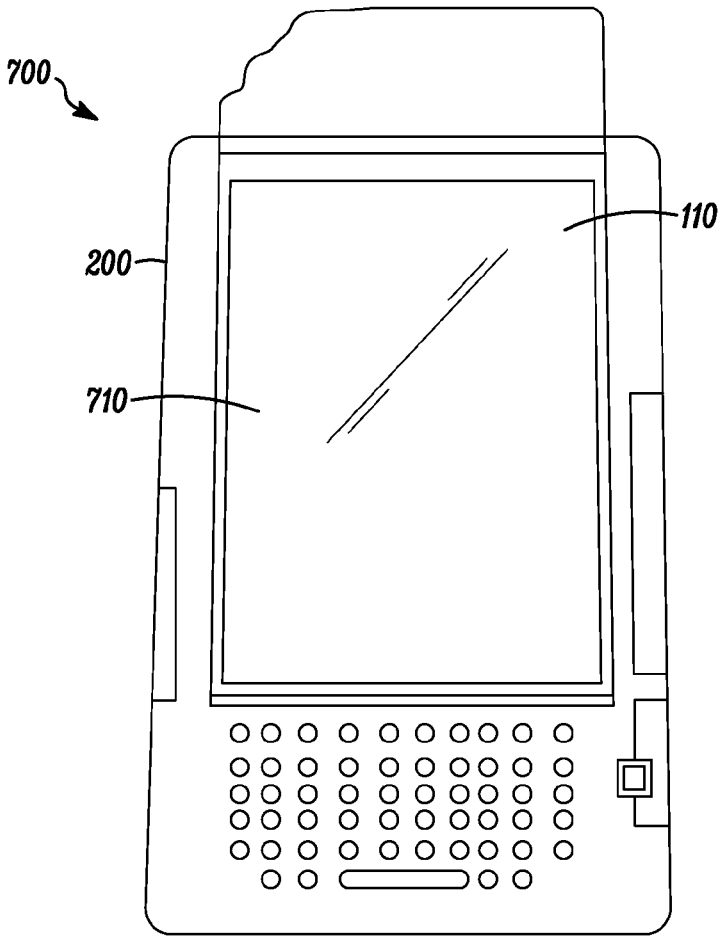
FIG. 7 is a plan view of an exemplary embodiment according to the present application on an e-book.

FIG. 7 is a plan view of another exemplary glowing e-reader light according to the present application on e-reader 200. Clip glow 700 attaches directly to e-reader 200 without the need for an e-book case. When clipped on e-reader 200, light transmissive element 110 of clip glow 700 is positioned over reading screen 710 of e-reader 200.

Figure 8:
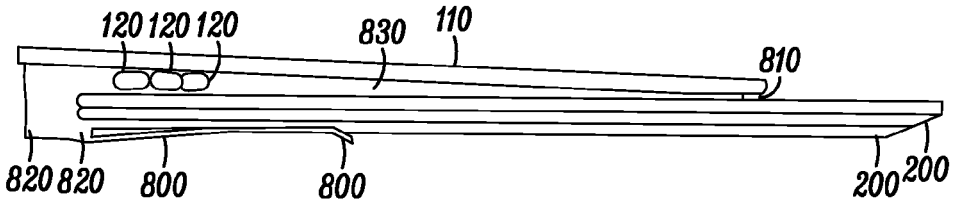
FIG. 8 is a side view of an exemplary embodiment according to the present application having a clip on an e-book in a use position.

FIG. 8 is a side view of an exemplary glowing e-reader light according to the present application having a clip on an e-reader 200 in a use position. Clip glow 700 attaches directly to e-reader 200 without the need for an e-book case. When clipped on e-reader 200 such that clip 800 is positioned on a back of e-reader 200, light transmissive element 110 of clip glow 700 is positioned over a reading screen of e-reader 200. Housing mount 820 may provide housing for a power source and LEDs 120, and may fixedly and slightly flexibly connect clip 800 and light transmissive element 110. Housing mount 820 may also provide, in conjunction with pads 810, gap 830 between e-reader 200 and light transmissive element 110.

Pads 810 (also referred to herein as feet, prominences, bumps, felt pads or spacer elements) at the lower corners of the sheet may be provided to keep the sheet off the surface of the e-book by a very small amount, and to allow light to escape through the small gap in the bottom thereby illuminating the buttons and/or controls that are generally found below the screens of the e-readers. Opaque borders on and around the transparent sheet may be provided to hide the LEDs from direct view and also block the light that would be reflected toward the user from the edges of the transparent sheet. Therefore, the viewer may be exposed to very little, if any, direct light as he or she views the e-book through the transparent sheet.

Figure 9:
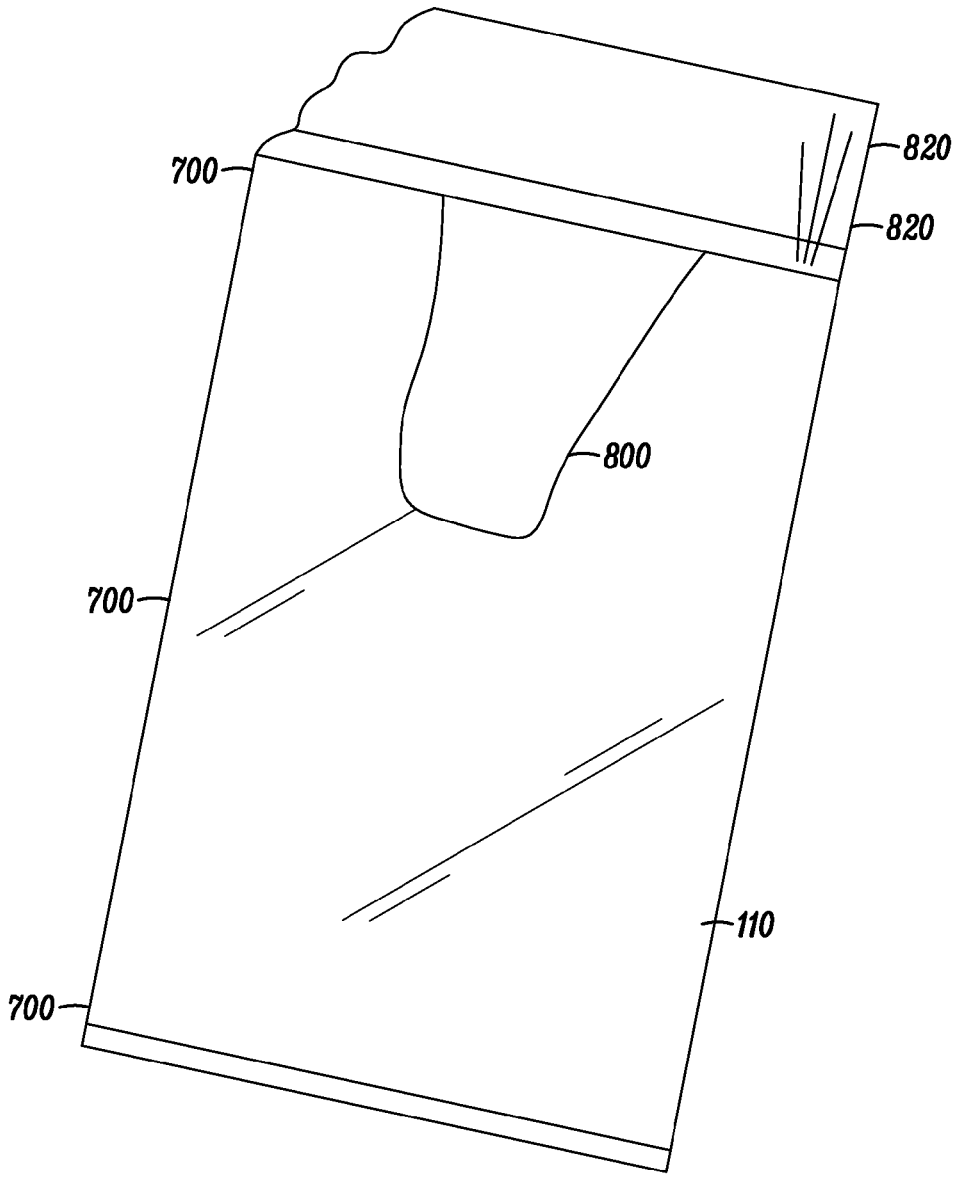
FIG. 9 is a plan view of an exemplary embodiment according to the present application having a clip.

FIG. 9 is a rear view of an exemplary glowing e-reader light according to the present application having a clip. Clip glow 700 is adapted to attach directly to an e-reader without the need for an e-book case. Power supply housing cover 900 may provide a cover for a power source and LEDs 120, and may fixedly and slightly flexibly connect clip 800 and light transmissive element 110. Attached to power supply housing cover 900 may be clip 800 that holds the whole device to the object it is intended to illuminate. Clip 800 may be made of shaped plastic or metal and work by means of gentle tension. Clip 800 also might be formed by a simple spring mechanism similar to a clothespin or bagclip. Clip 800 may gently but firmly clamp the e-book, or other object, from the back or from the back of the object's protective or decorative jacket.

Figure 10:
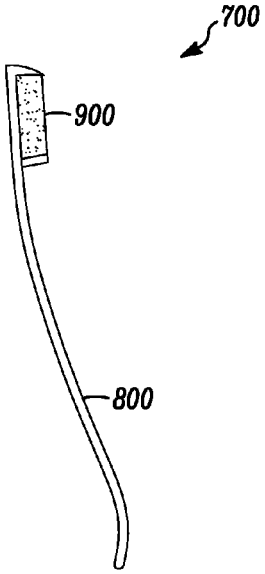
FIG. 10 is a side view of an exemplary clipping system of an exemplary embodiment according to the present application including a power supply.

FIG. 10 is a side view of an exemplary clipping system of an exemplary embodiment according to the present application including a power supply. Power supply housing cover 900 may be molded in one piece of plastic with clip 800. Removal of power supply housing cover 900 from clip glow 700 may provide a user with easy access to a power supply and/or LEDs for replacement, repair or any other purpose.

Figure 11:
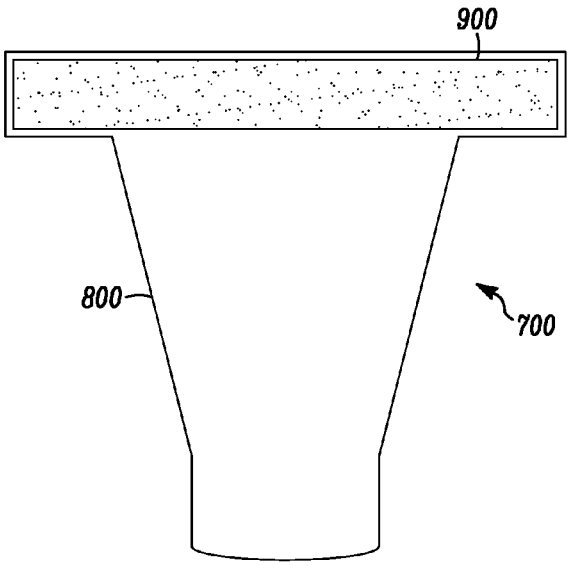
FIG. 11 is a plan view of an exemplary clipping system of an exemplary embodiment according to the present application including a power supply.

FIG. 11 is a plan view of an exemplary clipping system of an exemplary embodiment according to the present application including a power supply. Power supply housing cover 900 may be molded in one piece of plastic with clip 800.

Figure 12:
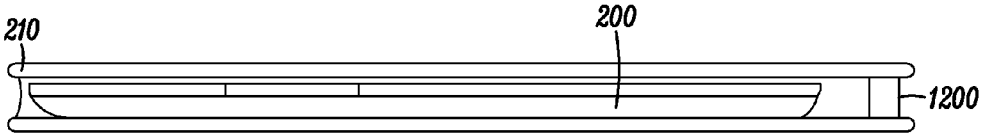
FIG. 12 is a side view of an exemplary embodiment according to the present application in an e-book case in a stored position.

FIG. 12 is a side view of another exemplary glowing e-reader light according to the present application in e-book case 210 in a stored position. E-book case 210 is not significantly thicker than e-reader 200 alone due to the position of hinge mount 1200 of the glowing e-reader light fitting in an area of e-book case 210 above e-reader 200.

Figure 13:
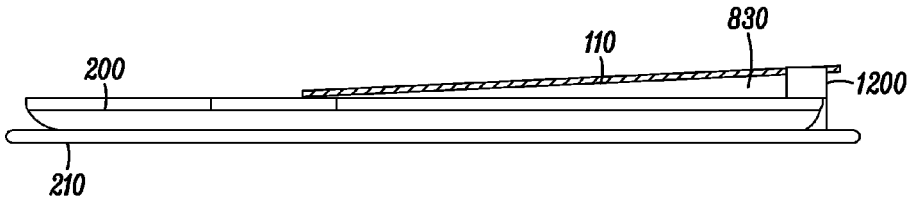
FIG. 13 is a side view of an exemplary embodiment according to the present application in an e-book case in a use position.

FIG. 13 is a side view of another exemplary glowing e-reader light according to the present application in e-book case 210 in a use position. In use, e-reader 200 rests on a back side of e-book case 210, and hinge mount 1200 swings up and over the top edge of e-reader 200, causing light transmissive element 110 to form gap 830 between e-reader 200 and light transmissive element 110.

Figure 14:
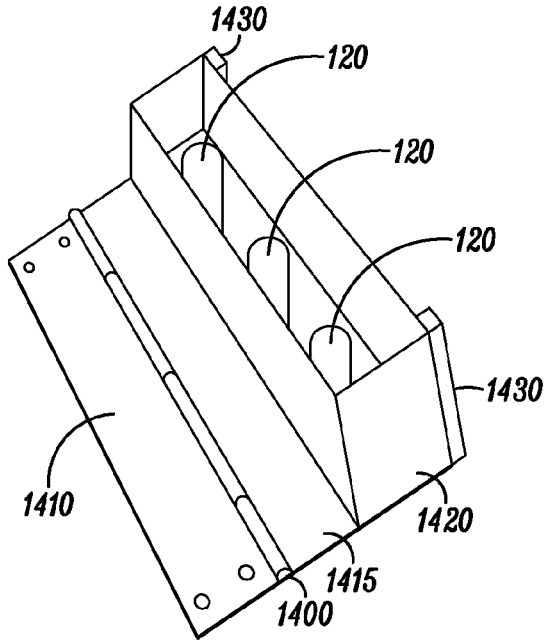
FIG. 14 is a perspective view of an exemplary mounting system of an exemplary embodiment according to the present application including lights in a stored position.

FIG. 14 is a perspective view of hinge mount 1200 including LEDs 120 in a stored position. Hinge 1400 is in an open position holding plate mount 1410 and connecting plate 1415 in a planar relationship. Plate 1415 is rigidly coupled to LED compartment 1420, which holds LEDs 120. Clips 1430 on a side of LED compartment 1420 opposite plate 1415, hinge 1400 and plate mount 1410 is provided for holding a light transmissive element in position. Alternative methods for holding a light transmissive element may be provided, including magnets, snaps, Velcro, or any other appropriate method. Plate mount 1410 is adapted to attach to an e-book case, and may be fixedly or removedly attached, by any appropriate method. The LED housing is mounted on the inside of the case beneath the e-reader and is hinged to lie flat when not in use. The power supply in this exemplary embodiment may be contained along the inside spine of the carrying case. The viewing screen may be detachable and may be stored in a pocket built into the top flap of the carrying case.

In exemplary variations of the present invention for use with a case, a pocket for the device when not in use is provided, and the bottom of the pocket may be positioned at the appropriate level so that when the case is closed, the light transmissive element lays against the e-book, and the power unit and light mount occupy an areas on the edge of the e-book case and do not contribute to the thereby enabling the e-book, e-book case, and invention to have a low profile.

Figure 15:
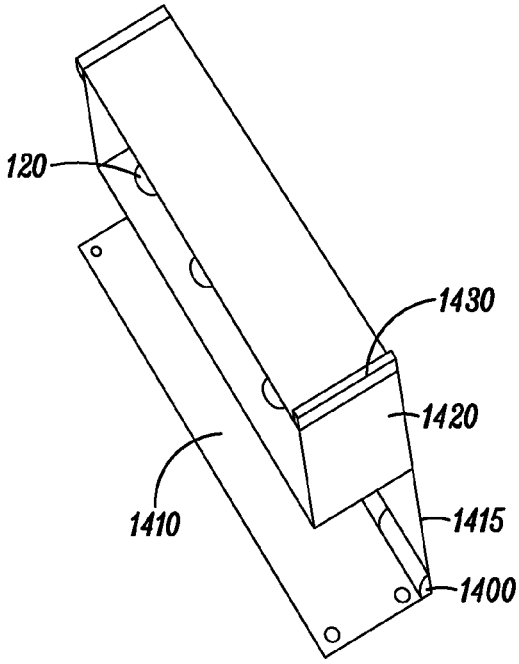
FIG. 15 is a perspective view of an exemplary mounting system of an exemplary embodiment according to the present application including lights in a use position.

FIG. 15 is a perspective view of hinge mount 1200 including LEDs 120 in in a use position. Hinge 1400 is in a closed position holding plate mount 1410 and connecting plate 1415 at an angular relationship that may be approximately 90 degrees. In the use position, a top edge of an e-reader in the e-book case to which holding plate mount 1410 is mounted may fit into space 1500 formed between holding plate mount 1410 and a side of LED compartment 1420 towards plate 1415, hinge 1400 and plate mount 1410. In the use position, LEDs 120 may be aligned substantially parallel to an e-reader in the e-book case to which holding plate mount 1410 is mounted. Also in the use position, a light transmissive element attached to clips 1430 may be aligned substantially parallel to an e-reader in the e-book case, or more specifically at a slight angle to an e-reader. The height of LED compartment 1420 may define the gap between the light transmissive element and the e-reader.

Figure 16:
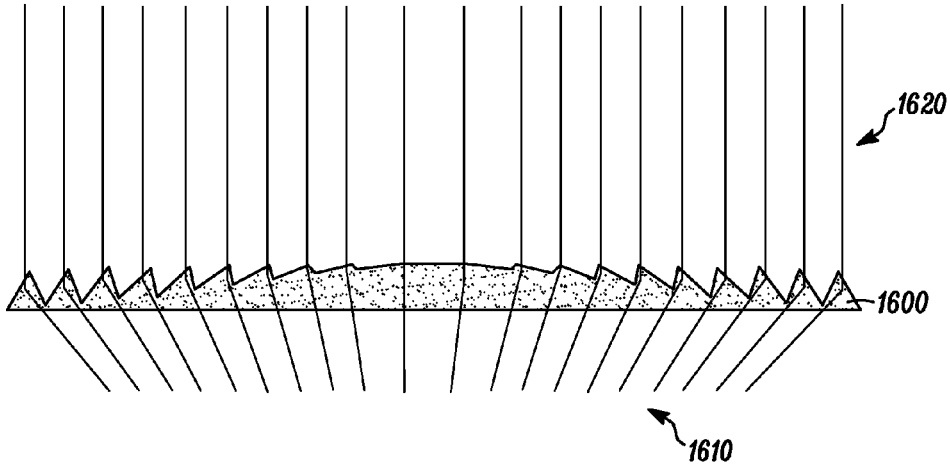
FIG. 16 is a plan view of an exemplary lens system using a Fresnel lens and including a ray diagram.

FIG. 16 is a plan view of an exemplary lens system using Fresnel lens 1600. Source light 1610 emanates from a point source, which may be an LED. Fresnel lens 1600 operates to straighten the light rays so that emitted light rays 1620 are substantially parallel. Fresnel lens 1600 accomplishes the straightening by use of the appropriate angles on an outer edge of Fresnel lens 1600 in view of the refractive index of the material of which Fresnel lens 1600 is constructed. Fresnel lens' are used in car headlights.

Figure 17:
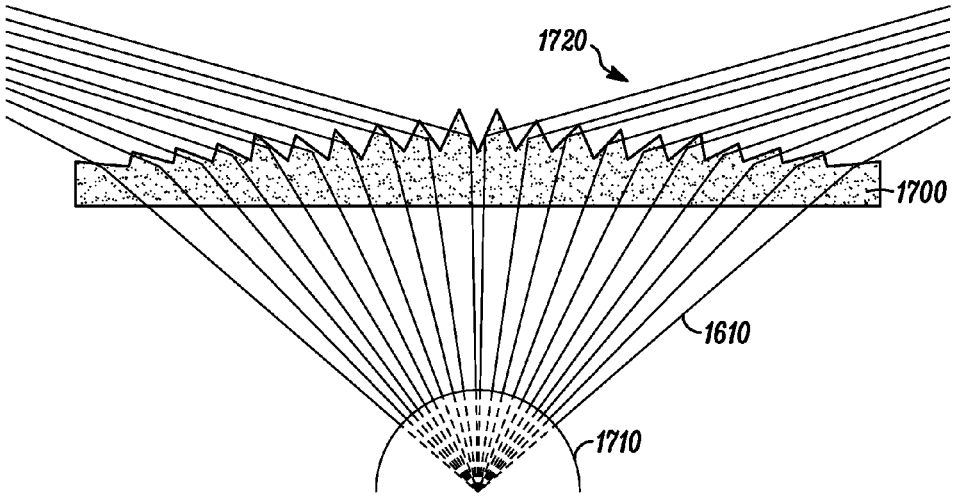
FIG. 17 is a plan view of an exemplary lens system using an inverse Fresnel lens system according to the present invention and including a ray diagram.

FIG. 17 is a plan view of inverse Fresnel lens system 1700. Source light 1610 emanates from point source 1710, which may be an LED. Inverse Fresnel lens system 1700 operates to spread the light rays so that emitted light rays 1720 diverge and are well-distributed. Inverse Fresnel lens system 1700 accomplishes the diverging by use of the appropriate angles on an outer edge of inverse Fresnel lens system 1700 in view of the refractive index of the material of which inverse Fresnel lens system 1700 is constructed. Inverse Fresnel lens systems such as inverse Fresnel lens system 1700 may be used as lens' or covers for the LEDs in an exemplary glowing e-reader light.

Figure 18:
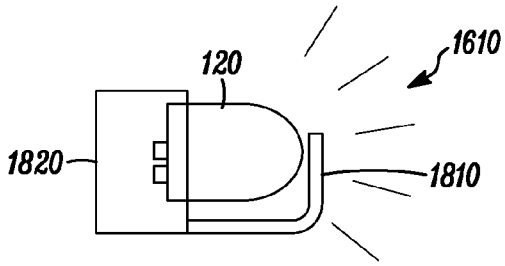
FIG. 18 is a sectional view of an exemplary lens and light system using an inverse Fresnel lens system according to the present invention.

FIG. 18 is a sectional view of exemplary lens 1810 and LED 120 using an inverse Fresnel lens system according to the present invention. LED is positioned to emit source light 1610 and is mounted on LED mount 1820. Extending from LED mount 1820 is lens 1810 which may cover all or part of LED 120, and in particular may extend up from a bottom and cover approximately half of the LED 120. Exemplary lens 1810 may be made of plastic, glass or any other appropriate material.

Exemplary lens 1810 may be made of a standard light diffusing material, and/or may be molded into lens sections in front of each of the lights. These lenses may be shaped in a form of inverted Fresnel lens. As discussed, a standard Fresnel lens takes the light coming from a given source and collimates, or straightens, it into a generally straight beam. An inverse or inverted Fresnel lens according to the present invention shifts the angles of the prisms involved in the Fresnel lens so that the light spreads instead of focuses. Each ridge of the lens is a prism derived from a Fresnel lens but placed so that the center prisms refract the beams to the greatest angles and decrease in angularity as they move toward the outer edges of each light. The result is that the light coming from below and the sides spreads to fill in the gaps between the bulbs and even out the distribution of light rays.

Figure 19:
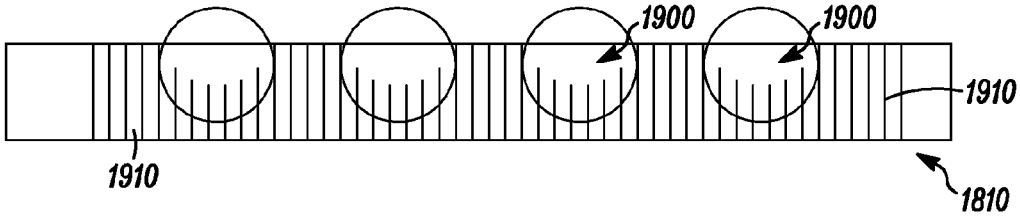
FIG. 19 is a front view of an exemplary lens and light system using an inverse Fresnel lens system according to the present invention.

FIG. 19 is a front view of exemplary lens 1810 and light system using an inverse Fresnel lens system according to the present invention. Exemplary lens 1810 includes inverse Fresnel lens sections 1910, and clear sections 1900 that are positioned over each position for an LED.

Figure 20:
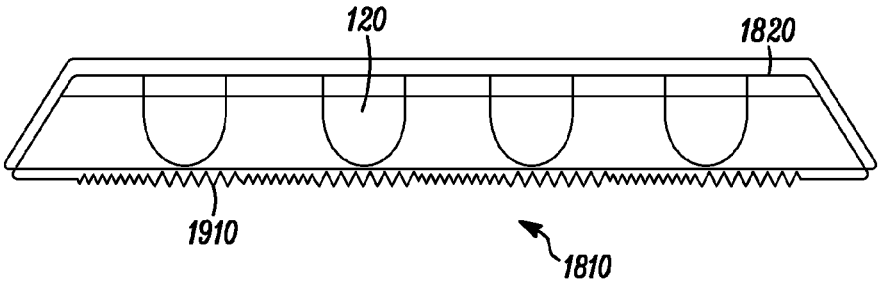
FIG. 20 is a plan view of an exemplary lens and light system using an inverse Fresnel lens system according to the present invention.

FIG. 20 is a plan view of exemplary lens 1810 and light system according to the present invention. Exemplary lens 1810 includes inverse Fresnel lens sections 1910. The light system includes LEDs 120 mounted on LED mount 1820.

Figure 21:
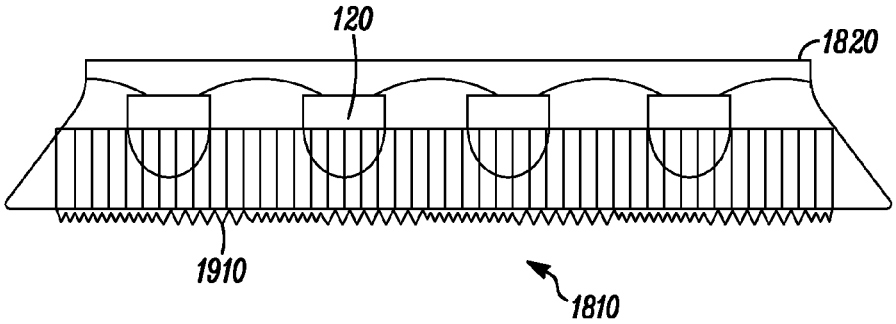
FIG. 21 is a bottom view of an exemplary lens and light system using an inverse Fresnel lens system according to the present invention.

FIG. 21 is a bottom view of exemplary lens 1810 and light system according to the present invention. Exemplary lens 1810 includes inverse Fresnel lens sections 1910. The light system includes LEDs 120 mounted on LED mount 1820.

Figure 22:
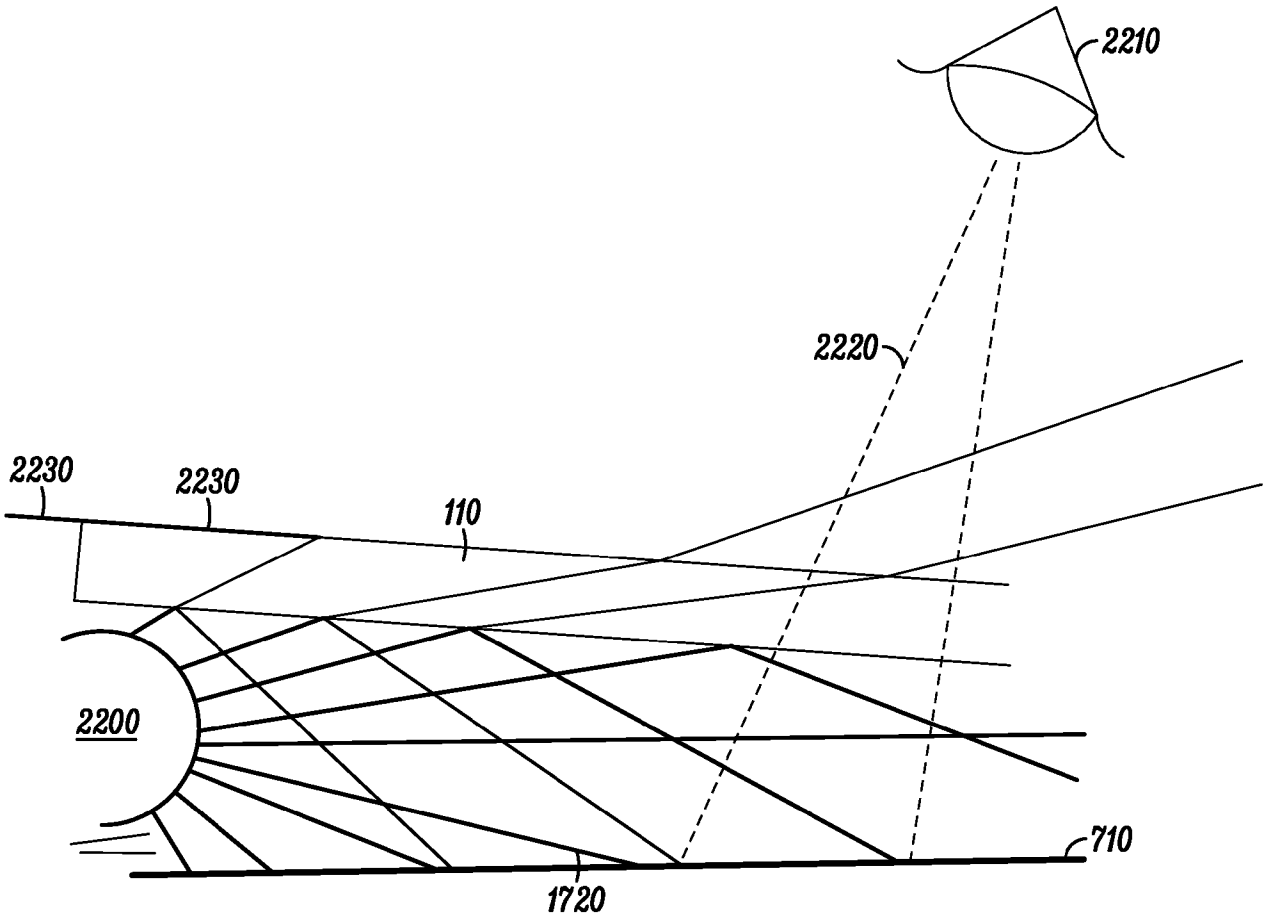
FIG. 22 is a side view of an exemplary system according to the present invention and including a ray diagram and an observer position.

FIG. 22 is a side view of an exemplary system according to the present invention and including a ray diagram and an observer position. Spread light source 2200 may provide light rays having an approximately 30 degree spread, and may comprise LEDs and inverse Fresnel lens system. Spread light source 2200 may provide emitted light rays 1720 that diverge, with some striking a bottom surface of light transmissive element 110 and other striking reading screen 710 of an e-reader. The light rays striking the bottom surface of light transmissive element 110 may do so at a shallow, or grazing angle, also referred to as a high incidence angle. These light rays may substantially reflect down onto reading screen 710 of an e-reader. All of the light rays striking reading screen 710 of an e-reader may reflect off and strike light transmissive element at a low incidence angle and pass through as emitted rays 2220 to observer 2210. Opaque covering 2230 may be provided on an upper or lower surface of light transmissive element 110 in the vicinity of spread light source 2200 to prevent the initial escape of light emitted from spread light source 2200 prior to reflection off of reading screen 710 of an e-reader.

In order to help spread the light evenly and decrease hot or bright spots, the LED housing has a highly reflective coating on the wall behind the lights and on angled side walls adjacent to the outermost LEDs. Additionally or alternatively, in front of the lights and below, a specific area of diffusion may be provided in the form of a molded plastic section that is part of the LED housing. The diffusing or spreading section is under or beneath the lights and may come up to half way through the front area of the bulb. The upper area may be left clear to prevent the buildup of heat in an area of the light transmissive element.

Mathematical models of the paths of the light rays illustrate the effectiveness of the device in bringing light to the surface of the e-reader, and the distribution of the light as it goes from the top to the bottom of the page.

Figure 23:
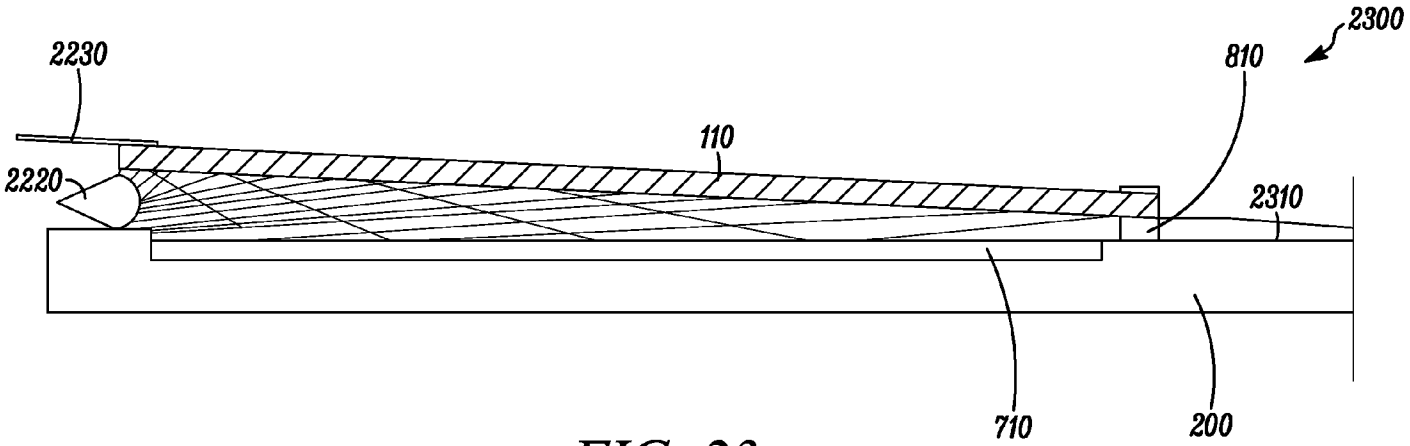
FIG. 23 is a ray diagram showing a light source and e-book according to the present invention with a light re-directing element and is from a two dimensional mathematical model of the system for a case in which only a few rays are shown for illustrative purposes.

FIG. 23 is ray diagram 2300 showing spread light source 2200 and e-reader 200 having reading screen 710 according to the present invention. Light transmissive element 110 serves to reflect a substantial number of light rays onto reading screen 710. Pads 810 serve to allow some of the light rays to pass out of the gap at the bottom of light transmissive element 110 and reading screen 710. These light rays may help illuminate controls 2310 of e-reader 200 that are situated below reading screen 710.

Figure 24:
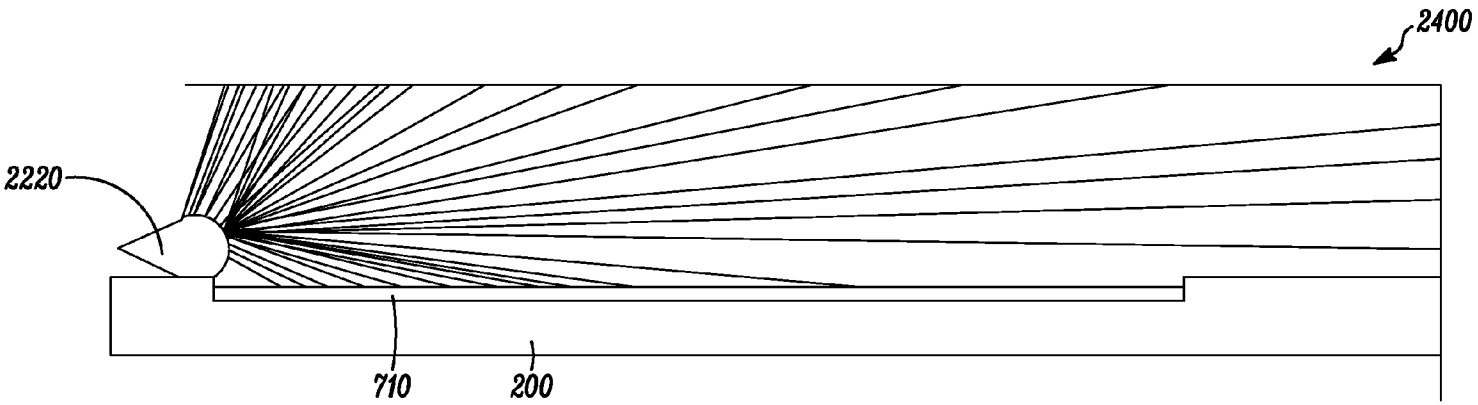
FIG. 24 is a ray diagram showing a light source and e-book according to the present invention without a light re-directing element and is from a two dimensional mathematical model of the system for a case in which only a few rays are shown for illustrative purposes.

For illustrative purposes, the number of rays shown here is far fewer than the number used in the computer runs that were made to produce the graphs and numerical results shown in FIGS. 24-28. The number of rays shown in FIGS. 23 and 24 are for the case of the mathematical model using an LED having 20 point sources of light distributed uniformly over the arc of the face of the LED, with each of those sources emitting 15 rays. In contrast, the model used for the results shown in FIGS. 24-28 had 400 sources of light with each emitting 400 rays. In these cases the rays were so densely packed that no individual ray was discernible. For all cases, in the model there was a small amount of randomness introduced into the emitted ray angles in order to break up regular ray patterns that would form due to the uniform distribution of the light sources and the uniform distribution of ray angles.

Ray diagram 2300 was created using the following values, with lengths measure in inches. The various dimensions used in the mathematical model were taken from a working prototype. The length of light transmissive element 110 is 5 and 3/16, the thickness of light transmissive element 110 is 1/8, and the height of pads 810 is 3/16. The height of spread light source 2200 is 9/32, the gap above spread light source 2200 is 1/32, and the gap below spread light source 2200 is 0.

FIG. 24 is ray diagram 2400 showing spread light source 2200 and e-reader 200 having reading screen 710 without a light transmissive element to reflect light rays onto reading screen 710. As is apparent, fewer rays of light illuminate reading screen 710 of e-reader 200. The number of rays is the same as for FIG. 23.

Figure 25:
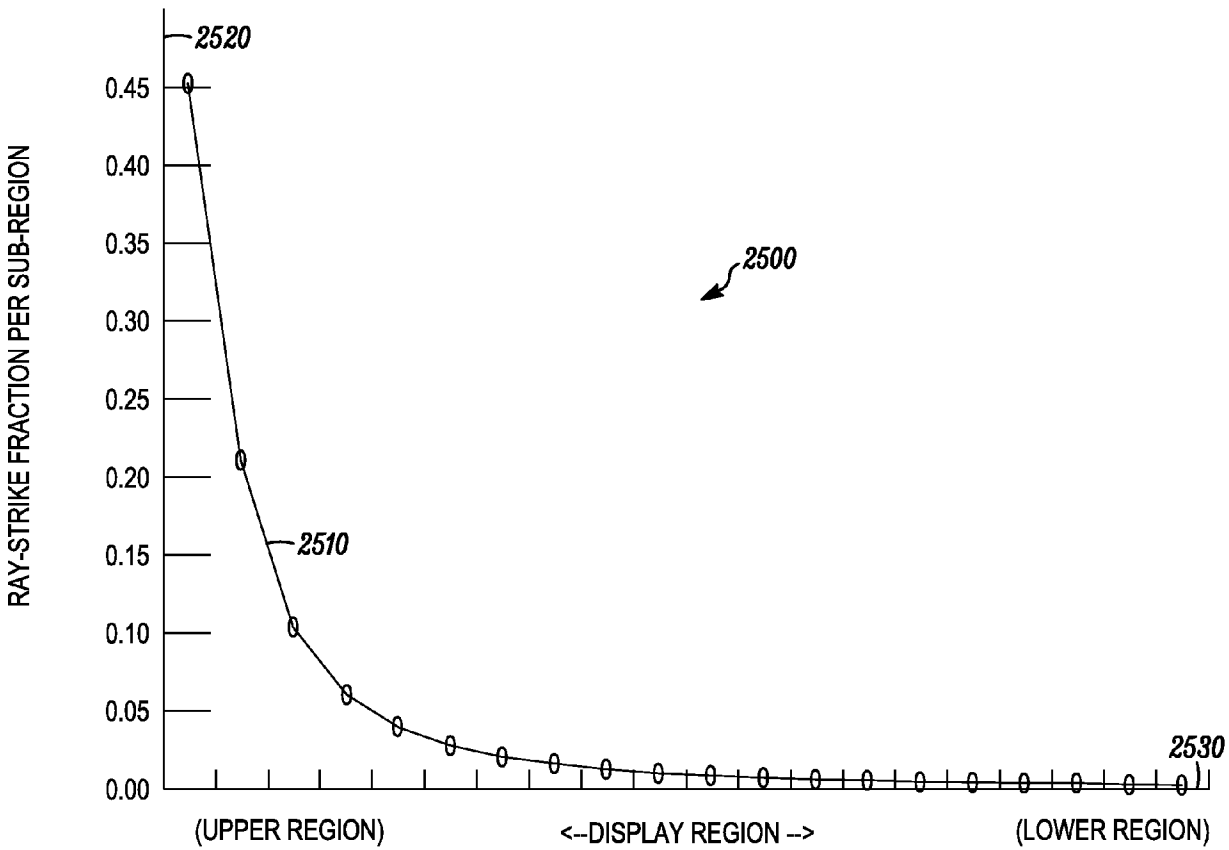
FIG. 25 is a graph showing the computed ray strike distribution along the e-book's display screen, expressed as the fraction of rays hitting the screen, for the case without the light re-directing element present and with the model using 533 times the number of rays used for FIGS. 23 and 24.

FIG. 25 is graph 2500 obtained from the mathematical model illustrating the ray-strike distribution along a display without a light re-directing element. In the 2-D ray-tracing model, which also pertains to FIG. 26, the light field from the LED is approximated by distributing 400 point light sources uniformly over the circular-arc face. Each source is considered to emit 400 rays covering the 180 angle range subsumed by the tangent line to the face at the source location. However, those rays that are vertical or pointed rearward are not considered to emit light. All rays are considered terminated when they strike the e-reader surface. Rays that strike the light re-directing element surface are followed through one reflection. The primary interest is in the rays that strike the display surface, either directly or after one reflection from the light re-directing element. The distribution of light along the display surface is obtained by counting the number of rays striking the display in each of 20 equal-length sub-regions along the display surface. X-axis 2530 shows how the distance along the display was divided into the 20 sub-regions. The total ray count per sub-region is divided by the total number of rays striking the display. The value shown for each sub-region is thus the fraction of the total number of rays striking the display. Y-axis 2520 is this fractional value, and curve 2510 shows the variation of the ray-strike fraction per sub-region with distance along the display.

Figure 26:
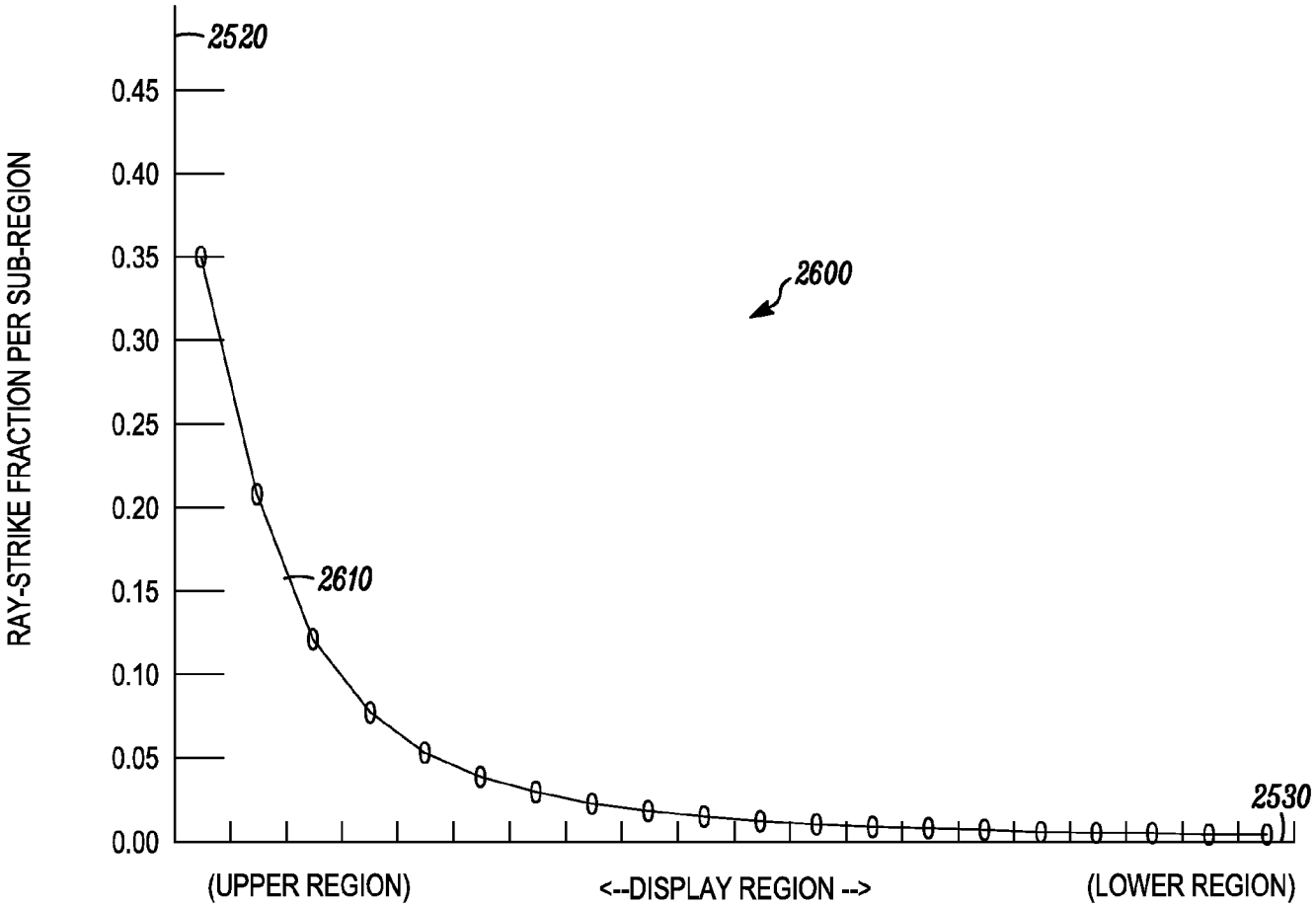
FIG. 26 is a graph showing the computed ray strike distribution along the e-book's display screen according to the present invention, expressed as the fraction of rays hitting the screen, for the case with the light re-directing element present and including only direct and single-reflection light rays and with the model using 533 times the number of rays used for FIGS. 23 and 24.

FIG. 26 is graph 2600 showing the ray-strike distribution along a display with a light re-directing element. Y-axis 2520 shows ray-strike fraction per subregion, while x-axis 2530 shows the regions of the display divided into 20 parts, with the upper region positioned towards the origin. Curve 2610 shows the variation of the ray-strike fraction per sub-region with distance along the display. When compared to FIG. 25, it is apparent that the presence of the device raises the number of rays hitting the top half by a bit more than 2.5 times, and perhaps more importantly, increases the number of rays hitting the lower half by nearly 5 times. An exemplary device according to the present invention including a light transmissive element brings significantly more light to the lower half of the screen, thus evening out the appearance of the light distribution.

Figure 27:
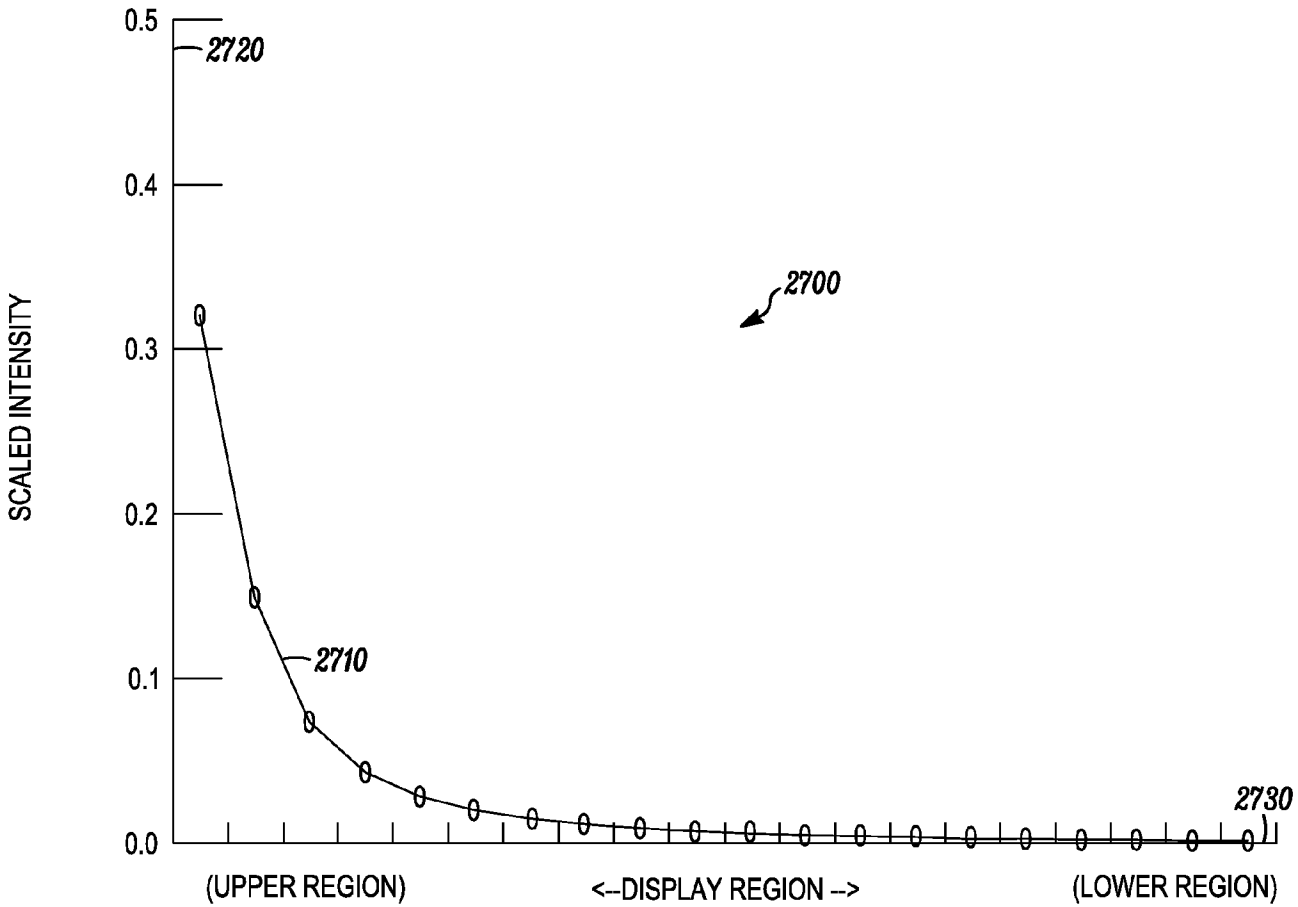
FIG. 27 is a graph showing the computed scaled light intensity distribution without a light re-directing element.

FIG. 27 is graph 2700 showing the scaled light intensity distribution along a display without a light re-directing element. Y-axis 2720 shows scaled light intensity per subregion, while x-axis 2730 shows the regions of the display divided into 20 parts, with the upper region positioned towards the origin. Curve 2710 indicates the scaled light intensity in each region, illustrating the power that an e-reader receives from the light without the device present.

Intensity is a measure of power passing into an area. In the graph in FIG. 27 and the graph in FIG. 28, the e-reader display length has been divided into 20 equal-length sub-region areas. The power delivered to each sub-region is computed. Each ray is considered to transmit a unit power rate, and each ray striking a sub-region directly from the LED is considered to be transmitting a unit rate of power to the sub-region. Rays reflected from the light re-directing element transmit a smaller amount to the display surface because in the reflection process part of the energy passes through the element. This loss is taken into account by multiplying the unit power rate of the ray by the so-called reflection coefficient. The reflection coefficient depends on the angle the ray strikes the element surface, and its value is computed using theoretically-derived expressions—the Fresnel formulas and using for the value of the index of refraction of the element the value for glass. The reflection coefficient varies from 0.04 (light perpendicular to the element surface) to 1.0 (light parallel to the surface). The power rates of all the rays striking each sub-region are summed to obtain the intensity of energy striking the sub-region. The values are then scaled by dividing each sum by the total number of emitted rays and multiplying by 3. This is done so that the values fit on a graph with a vertical axis limit of 0.5 (which may be any arbitrary value), regardless of the number of rays used in the analysis.

According to the mathematical model, the total scaled power delivered to the display area is 0.71. The scaled power delivered to the display upper half is 0.68. This value is 95% of the scaled power delivered to the display area. The scaled power delivered to the display lower half is 0.03. This value is 5% of the scaled power delivered to the display area. The resulting ratio of lower half to upper half delivered power is 0.05.

Figure 28:
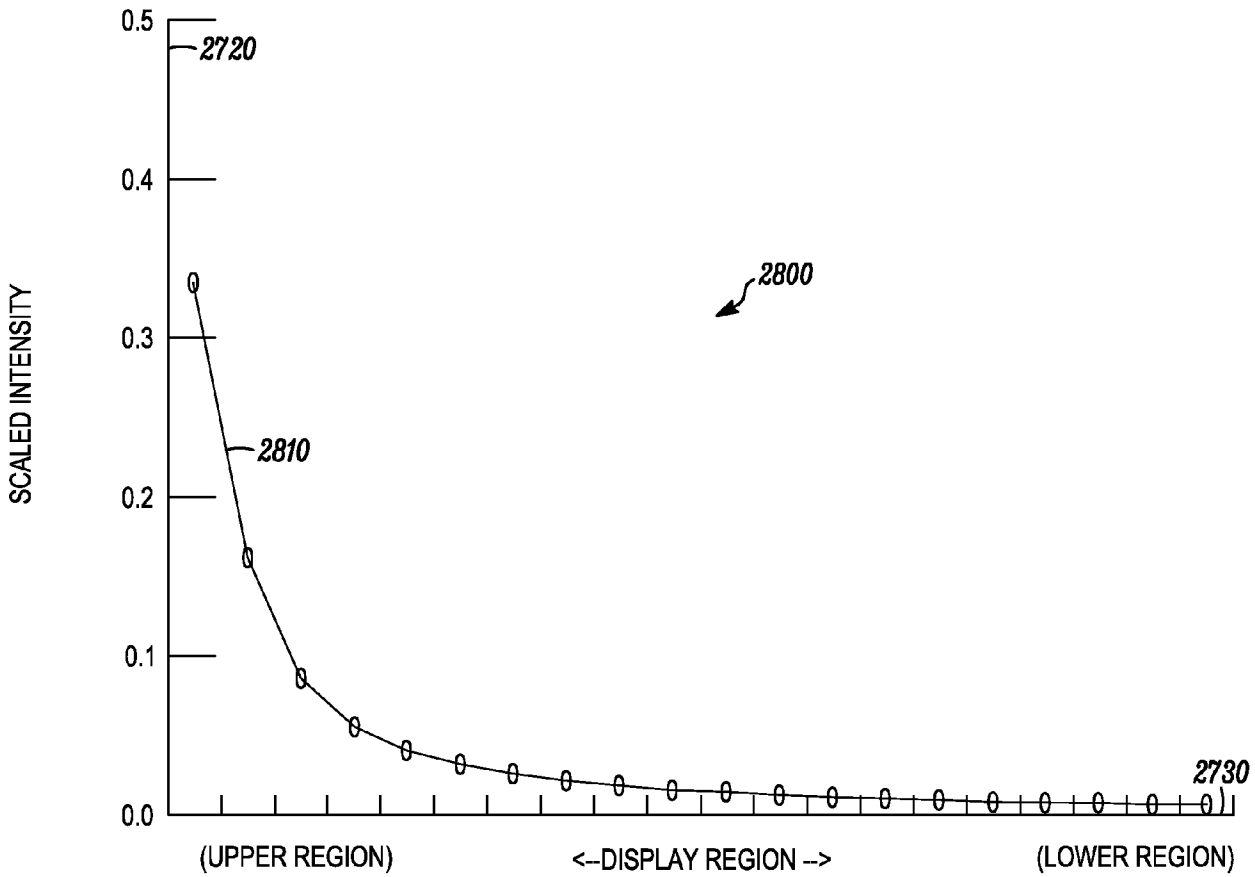
FIG. 28 is a graph showing the computed scaled light intensity distribution along a display including only direct and single reflection light rays according to the present invention.

FIG. 28 is graph 2800 showing the scaled light intensity distribution along a display with a light re-directing element, including only direct and single reflection light rays. Y-axis 2720 shows scaled light intensity per subregion, while x-axis 2730 shows the regions of the display divided into 20 parts, with the upper region positioned towards the origin. Curve 2810 indicates the scaled light intensity in each region, illustrating the power that an e-reader receives from the light with the device present. As is apparent from curve 2810, there is a significant increase brought by the presence of an exemplary device according to the present invention including a light transmissive element. This shows the ratio of the power received by the lower half compared to the upper has increased about 2.4 times that of the power received when a light transmissive element is not present.

According to the mathematical model, the total scaled power delivered to the display area is 0.88. The scaled power delivered to the display upper half is 0.79. This value is 90% of the scaled power delivered to the display area. The scaled power delivered to the display lower half is 0.09. This value is 10% of the scaled power delivered to the display area. The resulting ratio of lower half to upper half delivered power is 0.11. The ratio of the power received by the lower half compared to the upper has increased about 2.2 times that of the power received when a light transmissive element is not present. A comparison of results for the two cases indicates that the power delivered to the display region was approximately 24% greater with the light re-directing element present. Furthermore, when the element was present the amount of power delivered to the lower half of the display was 2.6 times greater.

Figure 29:
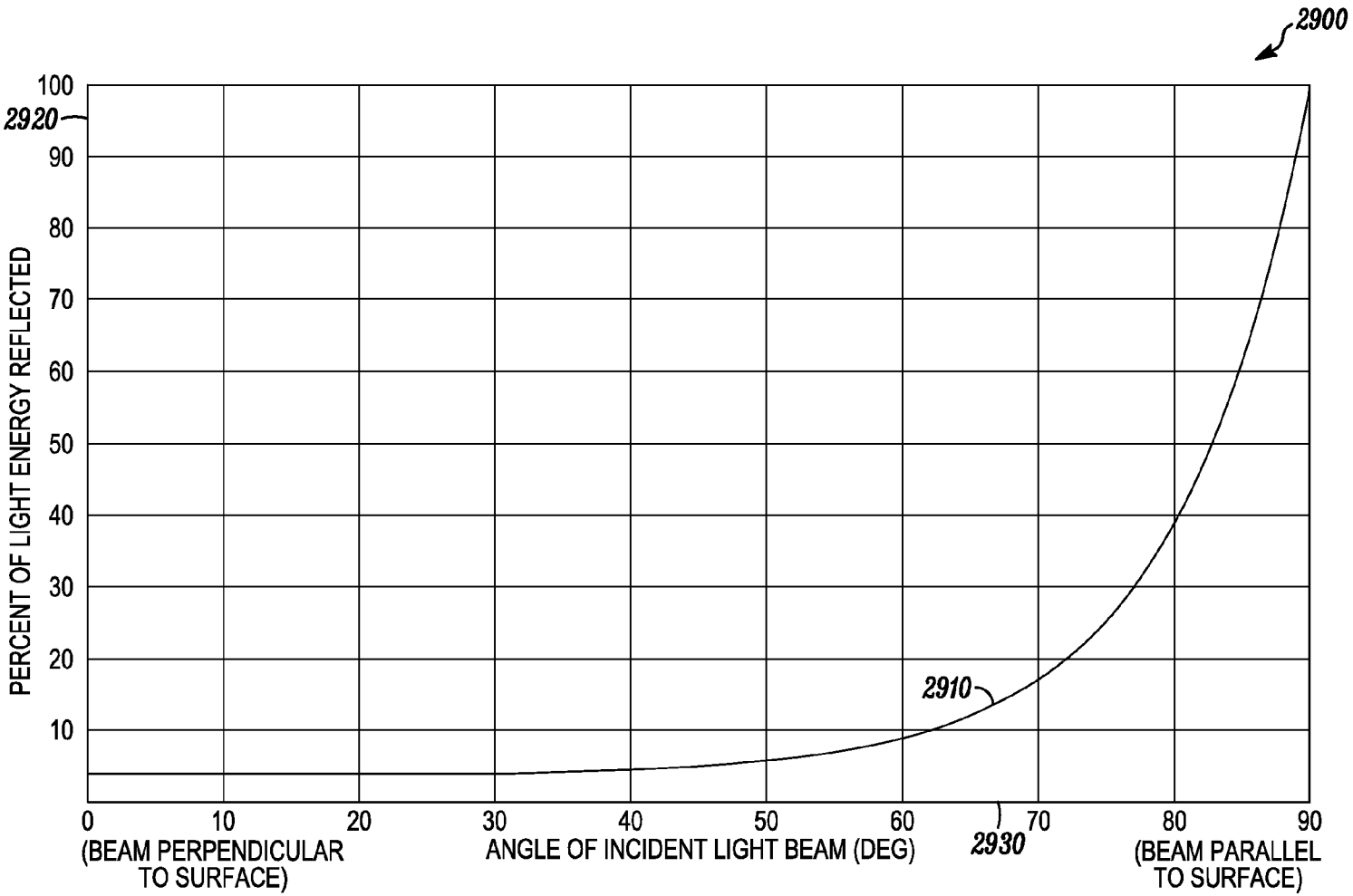
FIG. 29 is a graph showing the variation of the percent of energy reflected with angle of a light beam aimed at a glass surface.

FIG. 29 is graph 2900 showing the variation of percent of energy reflected with angle of light beam aimed at a glass surface. Y-axis 2920 shows the percent of light energy reflected, while x-axis 2930 shows the angle of the incident light beam in degrees. Curve 2910 indicates the variation of percent of energy reflected from a glass (or Plexiglas) surface as the angle of the beam changes from perpendicular to grazing. It is conventional to consider the incident angle to be measured from the perpendicular to the surface, and so an incident angle of 0 is for a light beam that is perpendicular to the surface. This curve was obtained using what are known as the Fresnel formulas, and the formulas were used in the mathematical model to obtain the amount of power that was reflected as a ray struck the light re-directing element.

Curve 2910 shows that there is a geometric curve of increasing reflection as the light beam is more parallel to the surface. Since the angle of my device is about 3 degrees, an exemplary device according to the present invention including a light transmissive element largely operates at the far right of graph 2900, at a point five degrees less than parallel, or about 85 degrees on x-axis 2930. As shown by graph 2900, about 65% of the light is reflected back from a light transmissive element in the direction of the e-reader. Therefore, the light from the LEDs or other light source is largely going to illuminate the surface of the e-reader, which is the desired result.

While only a limited number of preferred embodiments of the present invention have been disclosed for purposes of illustration, many modifications and variations could be made thereto. For instance, the light transmissive element described herein may be incorporated into the front cover of an e-book case, and may be provided with a scratch-resistant coating on an external side, so that the e-reader may be used with the light when the book case is closed. In this variation, the controls for the e-reader may be controlled through an opening in the e-book case cover that is permanent or closeable. The present application is intended to cover all of those modifications and variations which fall within the scope of the present invention, as defined by the following claims.

I claim:

1. A device for illuminating a surface of a member, comprising:

a light transmissive element having a substantially planar surface adapted to be situated over and separated from said member surface; and a light source adapted to emit light rays directed between said element surface and said member surface at an angle causing a substantial portion of said light rays to be reflected by said element surface onto said member surface to illuminate said member surface, and from said member surface through said element such that said illuminated member surface can be observed.

2. The device of claim 1, wherein:

said member comprises one of a book and an e-reader; and said element comprises at least one of glass, plexiglass and plastic.

3. The device of claim 1, further comprising:

spacer elements for maintaining the separation between said element surface and said member surface;

wherein said spacer elements allow a portion of said light rays to be projected on an area beyond a bottom edge of said element.

4. The device of claim 1, further comprising means for mounting said light source to direct said light rays between said element and said member.

5. The device of claim 1, further comprising means for mounting said element at said member with said light source therebetween, said element being inclined relative to said member.

6. The device of claim 1, further comprising:

a mount for said light source able to mounted in a use position and a stored position;

wherein said mount in said use position contacts a top edge of said surface of said member and said mount in said stored position is above said member.

7. The device of claim 6, further comprising:

a power supply electrically coupled to said light source;

wherein said power supply is positioned one of in the mount and in an e-reader holder.

8. The device of claim 6, further comprising:

means for removably attaching said element to said mount; and means for aligning said element when said element is attached to said mount.

9. The device of claim 6, further comprising:

a lens coupled to the mount in proximity to said light source;

wherein said lens spreads said light rays emitted from said light source.

10. The device of claim 1, wherein said light source is one or more LEDs.

11. The device of claim 1, wherein said element causes substantially all light rays intersecting said element at a high angle of incidence to be reflected.

12. The device of claim 11, wherein:

said light source is adapted to emit a first set of the light rays directed substantially parallel to said element to intersect the member at a first set of points without being reflected between the light source and the first set of points; and said light source is adapted to emit a second set of the light rays directed substantially parallel to said element to intersect said element at a second set of points without being reflected between the light source and the second set of points.

13. The device of claim 12, wherein:

said second set of said light rays intersect said element at angles greater than said high angle of incidence and are reflected;

said element is adapted to direct the reflected light rays toward the member;

said member is adapted to reflect a substantial portion of the light rays that are reflected by said element toward the member; and said element is adapted to transmit a substantial portion of the light rays reflected by the member toward said element at angles less than said high angle of incidence.

14. An apparatus for illuminating a surface of a member, comprising: means for reflecting light toward the member comprising a transparent element adapted to be positioned over the member and separated from the member by a gap; and means for emitting light into the gap, wherein the means for reflecting light causes substantially all light rays intersecting the transparent element at a high angle of incidence to be reflected, wherein:

the means for emitting light is adapted to emit a first set of the light rays directed substantially parallel to the element to intersect the member at a first set of points without being reflected between and the first set of points; and wherein the means for emitting light is adapted to emit a second set of the light rays directed substantially parallel to the element to intersect the element at a second set of points without being reflected between the light source and the second set of points.

15. The apparatus of claim 14, wherein:

the second set of the light rays intersect the element at angles greater than the high angle of incidence and are reflected;

the element is adapted to direct the reflected light rays toward the member;

the member is adapted to reflect substantially all of the light rays that are reflected by the element toward the member; and the element is adapted to transmit substantially all of the light rays reflected by the member toward the element at angles less than the high angle of incidence.

* * * * *